US006318255B1

(12) United States Patent
Larson

(10) Patent No.: US 6,318,255 B1
(45) Date of Patent: Nov. 20, 2001

(54) METHOD OF ATTACHING COATED SILK SCREEN FABRIC TO A FRAME AND THE REUSABLE SILK SCREEN

(76) Inventor: James D. Larson, 6323-83rd Ave. SE., Snohomish, WA (US) 98290-9208

( * ) Notice: Subject to any disclaimer, the term of this patent is extended or adjusted under 35 U.S.C. 154(b) by 0 days.

(21) Appl. No.: 09/499,872

(22) Filed: Feb. 7, 2000

(51) Int. Cl.[7] ..... B41C 1/14; B41L 13/02

(52) U.S. Cl. ..... 101/128.4; 101/127.1; 101/129; 101/128.1; 38/102.91; 160/378

(58) Field of Search ..... 101/127, 127.1, 101/128.1, 128.4, 129; 38/102, 102.1, 102.2, 102.91; 160/378, 379, 380, 391, 392, 403

(56) References Cited

U.S. PATENT DOCUMENTS 4,134,340 * 1/1979 Larson ..... 101/127.1
4,430,815 2/1984 Wulc ..... 101/127.1
4,860,467 8/1989 Larson ..... 101/127.1
5,113,611 5/1992 Rosson ..... 101/127.1
5,327,828 7/1994 Barocas et al. ..... 101/127.1
5,443,003 8/1995 Larson ..... 101/127

* cited by examiner

*Primary Examiner*—Leslie J. Grohusky
(74) *Attorney, Agent, or Firm*—Jensen & Puntigam, P.S.

(57) ABSTRACT

A method of locking a precut silkscreen fabric to splines which are then inserted into retensionable roller frames, wherein the fabric is scored where it contacts the spline, permitting the adhesive to lock the sections of the spline together through the scores in the fabric, mechanically locking the fabric in place.

4 Claims, 3 Drawing Sheets

FIG. 1
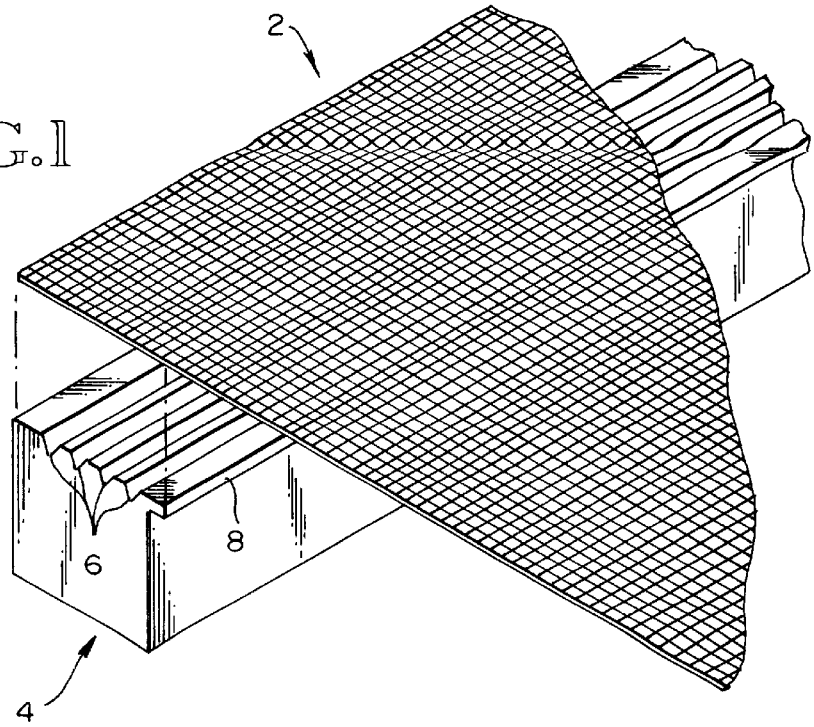
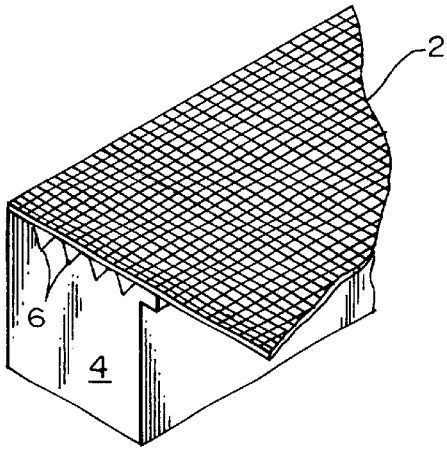
FIG. 2
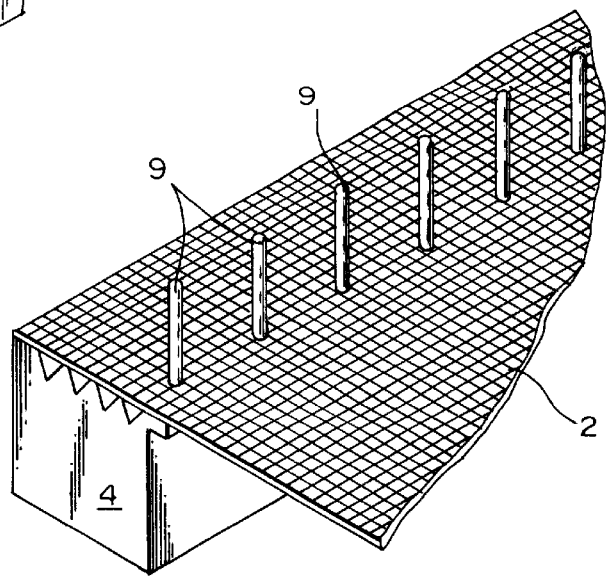
FIG. 3

METHOD OF ATTACHING COATED SILK SCREEN FABRIC TO A FRAME AND THE REUSABLE SILK SCREEN

TECHNICAL FIELD

This invention relates to the process of silk screening and more particularly to the method of attaching a coated silk screen fabric to a stretching frame and the resulting product.

BACKGROUND OF THE INVENTION

Historically, screen printing has been limited to the extent that the preparation of the materials is time-consuming, and therefore, expensive. Early screens were stretched in place, secured to a framework, trimmed to size, degreased, dried, coated with an emulsion coating, dried and then exposed to the desired image.

Over the past several years, the time consumption in silkscreen preparation has been reduced substantially through the use of retensionable frames including roller frames and then, even more recently, the provision of pre-cut fabrics which were cut to accommodate the predicted flexibility of the frames when under tension, further the fabric included splines attached to its edges to allow rapid attachment to the roller frames prior to tensioning, including snapping into slots in the roller.

Still more recently, in an attempt to reduce the time involved and to improve the consistency of the end product, it has been proposed that fabrics be pre-coated, substantially reducing the steps during preparation. However, the proposal has been for limiting the pre-coating of the central portion of the fabric, leaving the edges uncoated to eliminate perceived problems with the attachment of the coated fabric to the frames. The coating would obviously interfere with any adhesive securement.

Prior art known to the inventor includes:

U.S. Pat. No. 4,430,815 granted to Wulc on Feb. 14, 1984, which teaches the utilization of springs to provide for a limited amount of movement of the fabric toward the substrate;

U.S. Pat. No. 4,860,467 granted to Larson on Aug. 29, 1989, which teaches the method of securing the fabric to a stretching frame through the use of adhesive;

U.S. Pat. No. 5,113,611 granted to Rosson on May 19, 1992, which teaches a tensioning apparatus for stretching screen fabric, including at least one tensioning tool to selectively expand the frame to stretch the screen fabric thereon;

U.S. Pat. No. 5,327,828 granted to Barocas et al on Jul. 12, 1984, which teaches a clamping means and a process for protecting printing screens and frames;

U.S. Pat. No. 5,443,003 granted to Larson on Aug. 22, 1995, which teaches the utilization of a pre-cut fabric bordered with splines secured along the respective edges to facilitate the attachment of the fabric to a retensioning frame.

SUMMARY OF THE INVENTION

With the above-noted prior art and problems in mind, it is an object of the present invention to provide a method for securing a fabric to a tensioning frame including situations where a photosensitive emulsion coating covers the entire fabric.

It is another object of the present invention to provide a method of securing a precut coated fabric to an edge strip allowing rapid attachment to a stretching frame.

It is still a further object of the present invention to secure a treated fabric to an edge strip by temporarily securing the fabric to the edge strip, scoring the fabric and the edge strip at the same time, applying adhesive to the area which has been scored and overlying this area with a second strip whereby a physical connection is made between the two strips extending through the fabric and mechanically locking the fabric in place.

BRIEF DESCRIPTION OF THE DRAWINGS

FIG. 1 is a view of a pre-cut silkscreen of a coated fabric about to be attached to a portion of the spline.

FIG. 2 is a view of the fabric temporarily attached to a portion of the spline.

FIG. 3 is a view showing the scoring of the screen and the spline.

BEST MODE FOR CARRYING OUT THE INVENTION

Figure 4:
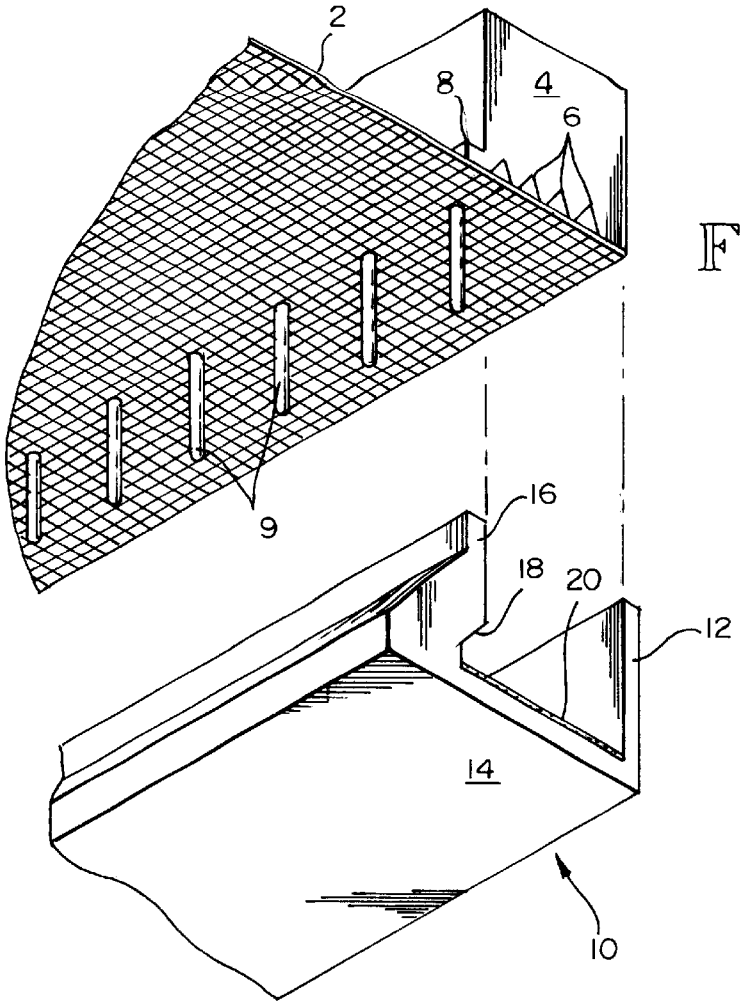
FIG. 4 depicts the screen temporarily attached to a portion of the spline prior to inserting into an elongated channel, the portion of the spline which enables securement to the stretching frame.

As seen in FIG. 1, a silkscreen fabric which has been pre-coated with a photo emulsion polymer which extends to the edges of the fabric which has been precut to accommodate a particular frame size and frame deflection created when the fabric is placed under tension is located above a spline member 4 fabricated of a plastic material, being generally rectangular in cross section of a length to accommodate the tensioning screen and including a plurality of the slots, grooves 6 or other integral receptacles in its upper surface as well as an outwardly projecting lip 8.

Although the present invention is shown and described with the method used in conjunction with a fabric which has been coated with a photosensitive emulsion extending to the edge of the fabric, it is to be understood that it could equally well be used with sectionally pre-coated fabrics or with fabrics which have no pre-coating.

As seen in FIG. 2, the fabric 2 is temporarily adhesively secured to the upper surface of the spline member 4 overlying the V slots 6.

As best seen in FIG. 3, the fabric 2 has now been temporarily adhesively secured to the spline 4 and a plurality of slits 9 have been cut in the fabric 2 and extending into the upper portion of the spline 4.

Figure 5:
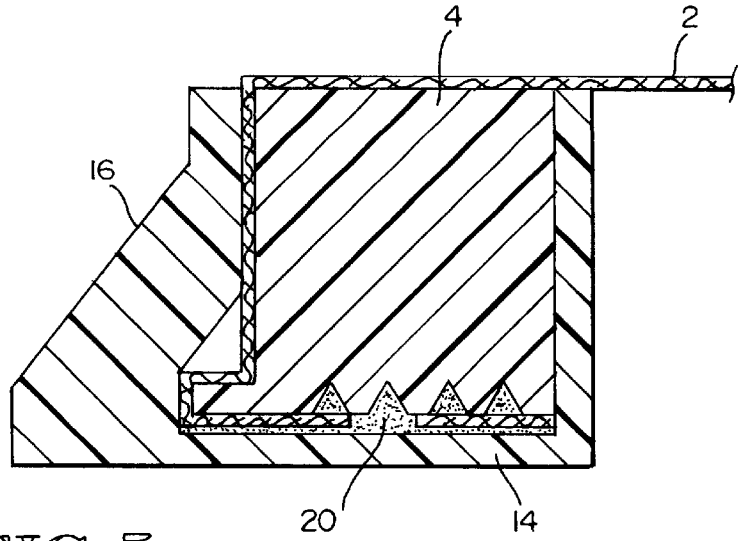
FIG. 5 shows the completed spline attached to the fabric, including showing the adhesive extending through the slots and the fabric providing a mechanical lock to the spline.

Attention is now directed to FIGS. 4 and 5 wherein the spline and attached scored screen material 2 is about to be placed within channel piece or elongated protective shield 10 which includes an elongated channel formed by wall 12, floor 14 and opposing locking wall 16 which includes a lateral indentation 18 to receive flange 8. Adhesive 20 is placed on the bottom and along the side of the channel member, the spline and attached fabric are inserted therein and as best seen in FIG. 5, the adhesive 20 is forced upwardly through slits 9 and fills the V-shaped notches or other integral receptacles 6 and forms a physical barrier preventing lateral movement of the fabric 2 when placed under tension.

Figure 6:
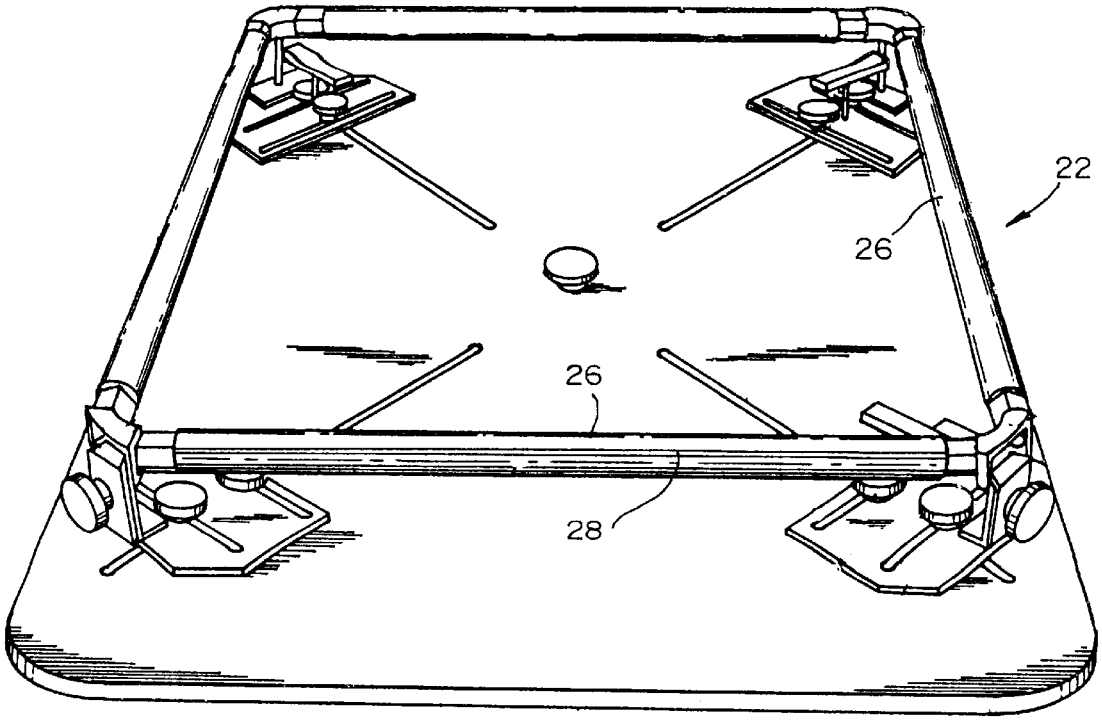
FIG. 6 is an isometric view of the retensionable frame for use in the silk screening process, wherein the frame includes an elongated slot in each roller to accommodate the edge splines on reusable screens.

The present invention is most efficiently used on a retensionable frame as seen in FIG. 6. A screen including the attached splines is secured to the frame 22. Each of the roller frame members 26 includes an elongated slot 28 into which the spline may be placed and then the roller frame members are turned to place the appropriate tension on the screen fabric.

Thus as can be seen, the present invention discloses an inexpensive and easy-to-use method of securing a coated fabric to a spline which is then quickly and easily placed within the roller frame of a frame member and tensioned to the appropriate degree.

It is to be understood that the fabric may be removed from the frame, stored and used again.

What is claimed is:

1. A method of attaching a coated screening fabric to a silk screen frame comprising the steps of:

a) cutting the fabric to size b) temporarily bonding the fabric to a spline strip along each edge of the fabric c) scoring the fabric along the spline strips d) adhesively securing the spline strips into elongated protective shields such that adhesive bonds the spline strips to the protective shields through the scored fabric e) placing each protective shield and attached spline strip in an elongated slot in the silk screen frame.

2. A method as in claim 1 further comprising scoring the spline at the same time as the fabric.

3. A silk screen as in claim 1 wherein each spline includes integral receptacles to accommodate excess adhesive.

4. A resusable silkscreen comprising:

a piece of coated silk screen material which has been cut to size and having a plurality of openings therein;

a plurality of splines, wherein the silk screen material is secured to one of said plurality of splines along each edge;

a plurality of elongated protective shields, each spline being adhesively secured to one of said elongated protective shields, and;

wherein the adhesive securement between each spline and each protective shield extends through said openings and said coated silk screen material, mechanically locking said coated silk screen material to each spline and protective shield.

* * * * *